US008210649B2

(12) United States Patent
Chen et al.

(10) Patent No.: US 8,210,649 B2
(45) Date of Patent: Jul. 3, 2012

(54) THERMAL OXIDE COATING ON A FLUID EJECTOR

(75) Inventors: Zhenfang Chen, Sunnyvale, CA (US); Gregory Debrabander, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 355 days.

(21) Appl. No.: 12/614,356

(22) Filed: Nov. 6, 2009

(65) Prior Publication Data

US 2011/0109694 A1 May 12, 2011

(51) Int. Cl.
*B41J 2/14* (2006.01)
*B41J 2/16* (2006.01)

(52) U.S. Cl. ..... 347/45; 347/64; 347/65

(58) Field of Classification Search ..... 347/29, 347/40, 45–47, 49, 64, 65, 67, 71; 29/25.35, 29/825, 830, 890.1
See application file for complete search history.

(56) References Cited

U.S. PATENT DOCUMENTS 5,800,650 A * 9/1998 Anderson et al. ..... 156/150
7,681,989 B2 * 3/2010 Lee et al. ..... 347/50
2004/0125169 A1 7/2004 Nakagawa et al.
2007/0030306 A1 2/2007 Okamura et al.
2008/0136866 A1 6/2008 Okamura et al.

FOREIGN PATENT DOCUMENTS

JP 09-057981 3/1997

OTHER PUBLICATIONS

Bhushan, "Springer of Nanotechnology," 2nd revised and extended edition, Springer Berlin Heidelberg, New York, (see pp. 305-306), 40 pages.
U.S. Appl. No. 12/346,698, filed Dec. 30, 2008, 27 pages.
U.S. Appl. No. 12/560,376, filed Sep. 15, 2009, 18 pages.

* cited by examiner

*Primary Examiner* — Thinh Nguyen
(74) *Attorney, Agent, or Firm* — Fish & Richardson P.C.

(57) ABSTRACT

A fluid ejection module includes a flow-path body, a first oxide layer, a membrane, and a second oxide layer. The flow-path body has a first outer surface and an opposing second outer surface and a plurality of flow paths, each flow path extending at least from the first outer surface to the second outer surface. The first oxide layer coats at least an interior surface of each of the flow paths and the first and second outer surfaces of the flow-path body and has a thickness that varies by less than 5% along {100} planes. The membrane has a first outer surface. The second oxide layer is coated on the first outer surface of the membrane and has a thickness that varies by less than 5% along {100} planes and is bonded to the first oxide layer.

19 Claims, 5 Drawing Sheets

THERMAL OXIDE COATING ON A FLUID EJECTOR

TECHNICAL FIELD

This disclosure relates generally to coatings on fluid ejectors.

BACKGROUND

A fluid ejector (e.g., an ink-jet printhead) typically has a plurality of interior surfaces defining fluid flow paths, an orifice through which fluid is ejected, and an exterior surface. When fluid travels through the fluid ejector, aggressive or alkaline fluids can attack the interior and exterior surfaces of the fluid ejector, causing degradation of the fluid ejector surfaces. Uneven fluid ejector surfaces cause variation from one fluid ejector to the next in an array of ejectors. Such non-uniformity can lead to non-uniformity and inaccuracies in the fluid ejection.

SUMMARY

In one aspect, a fluid ejection module includes a flow-path body, a first oxide layer, a membrane, and a second oxide layer. The flow-path body has a first outer surface and an opposing second outer surface and a plurality of flow paths, each flow path extending at least from the first outer surface to the second outer surface. The first oxide layer coats at least an interior surface of each of the flow paths and the first and second outer surfaces of the flow-path body and has a thickness that varies by less than 5% along {100} planes. The membrane has a first outer surface. The second oxide layer is coated on the first outer surface of the membrane and has a thickness that varies by less than 5% along {100} planes and is bonded to the first oxide layer.

This and other embodiments may optionally include one or more of the following features. The fluid ejector can further include a nozzle plate having a first outer surface and a third oxide layer coated on the first outer surface of the nozzle plate. The third oxide layer can have a thickness that varies by less than 5% and can be bonded to the first oxide layer. The first and second oxide layers can have a thickness of between approximately 0.1 and 5 μm, such as less than approximately 2 μm. The first and second oxide layers can each have a density of greater than about 2.0 g/cm$^3$, such as about 2.2 g/cm$^3$. The flow-path body can include silicon. The membrane can include single-crystal silicon. The first and second oxide layers can include silicon oxide. The first and second oxide layers can each have a thickness that varies by less than 3%.

In one aspect, a method of forming a fluid ejector includes forming a first thermal oxide layer on at least one surface of a membrane, forming a second thermal oxide layer on at least one surface of a flow-path body, the flow-path body having a plurality of flow paths, and bonding the first thermal oxide layer to the second thermal oxide layer.

This and other embodiments may optionally include one or more of the following features. Bonding the first thermal oxide layer to the second thermal oxide layer can include forming an oxide-to-oxide bond. Forming the second oxide layer can include forming a thermal oxide layer along a wall of each flow path. The second oxide layer can have a thickness that varies by less than 5% along {100} planes. The method can further include forming a third oxide layer on at least one surface of a nozzle plate and bonding the third oxide layer to the second oxide layer. The bonding can occur at a temperature of greater than approximately 1000° C. The temperature can be between approximately 1200° C. and 1300° C. The formed thermal oxide layers can be between approximately 0.1 μm thick and 5 μm thick, such as less than approximately 2 μm thick.

Certain implementations may have one or more of the following advantages. Using a thermal oxide process to coat the fluid paths creates a dense oxide layer. The dense oxide layer is inert and more resistant to etching by alkaline fluids than an underlying silicon layer. Further, forming a thermal oxide layer separately on a membrane, flow-path body, and nozzle plate and before bonding the parts together avoids having to heat the entire fluid ejector at temperatures sufficient to perform thermal oxidation. Not oxidizing the entire bonded fluid ejector prevents warping in the membrane, flow-path body, and nozzle plate that can be caused as a result of high temperatures necessary for oxidation. Reducing having warping allows for more consistent and accurate fluid droplet ejection.

The details of one or more embodiments are set forth in the accompanying drawings and the description below. Other features, objects, and advantages of the invention will be apparent from the description, drawings, and claims.

DESCRIPTION OF DRAWINGS

Like reference symbols in the various drawings indicate like elements.

DETAILED DESCRIPTION

During fluid droplet ejection, degradation of the fluid ejector can occur as a result of aggressive or alkaline fluids attacking the surfaces of the fluid ejector. A thermal oxide can be used to protect the exposed surfaces.

An apparatus for fluid droplet ejection can have a fluid ejection module, e.g., a quadrilateral plate-shaped printhead module, which can be a die fabricated using semiconductor processing techniques. The fluid ejector can also include a housing to support the printhead module, along with other components such as a flex circuit to receive data from an external processor and provide drive signals to the printhead module.

The printhead module includes a substrate in which a plurality of fluid flow paths are formed. The printhead module also includes a plurality of actuators, e.g., transducers, supported on the substrate to cause fluid to be selectively ejected from the flow paths. Thus, each flow path with its associated actuator provides an individually controllable MEMS fluid ejector unit.

Figure 1A:
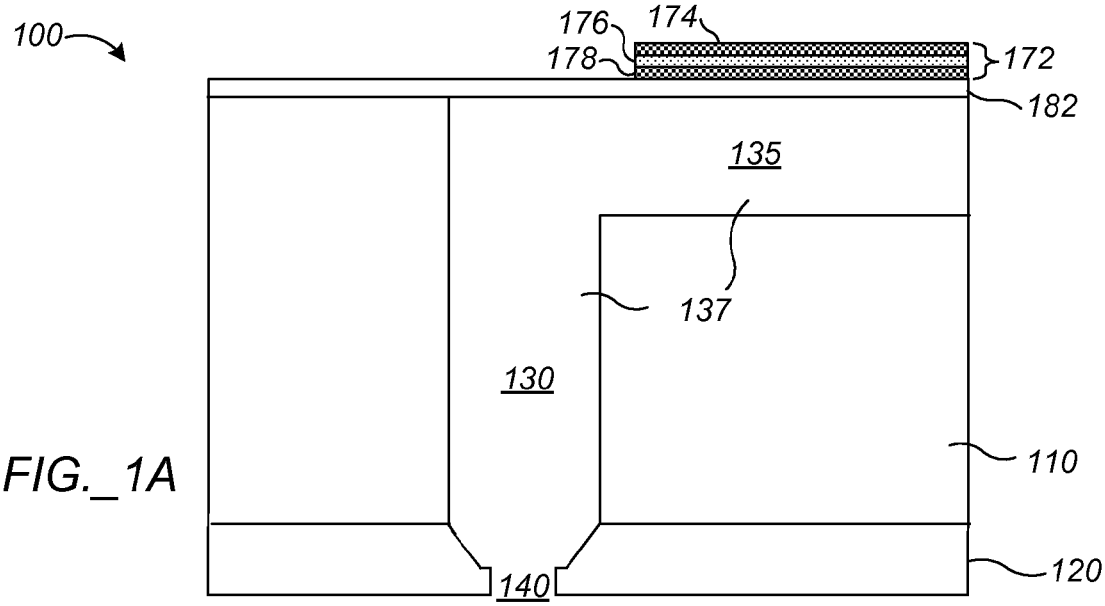
FIG. 1A is a cross-sectional view of an implementation of an uncoated fluid ejector.

FIG. 1A is a cross-sectional view of an uncoated fluid ejector unit of a fluid ejection module 100 (e.g., one nozzle of an ink jet printhead). The uncoated fluid ejector 100 includes a flow-path body 110 having a plurality of interior surfaces forming fluid paths 137 (for clarity, only one fluid path 137 is shown in FIG. 1A). The fluid ejector 100 further includes a nozzle plate 120 having orifices 140, each orifice connected to a fluid path 137. A membrane 182 is positioned above a pumping chamber 135 that is part of the fluid path 137. The flow-path body 110, membrane 182, and nozzle plate 120 can each be single-piece bodies of homogenous composition, e.g., consisting of silicon, e.g., single-crystal silicon, e.g., having a (100) orientation. The membrane 182, flow-path body 110, and nozzle plate 120 can be formed as separate parts and then bonded together to form the fluid ejector 105. Alternatively, two or more of the parts can be made of a single continuous material. The membrane 182, flow-path body 110, and nozzle plate 120, along with any oxide layers formed thereon as discussed below, can together provide the substrate.

An actuator 172 supported on the substrate pressurizes fluid (e.g., an ink, for example, a water-based ink) in the pumping chamber 135 and the fluid flows through a descender 130 and is ejected through an orifice 140 in the nozzle layer 120. The actuator 172 can include a piezoelectric layer 176, a lower electrode 178 (e.g., a ground electrode), and an upper electrode 174 (e.g., a drive electrode). The actuator 172 is not shown in the following figures, but can be present. Other configurations of flow paths 137 and actuators can alternatively be used with the coatings and techniques described herein.

Figure 1B:
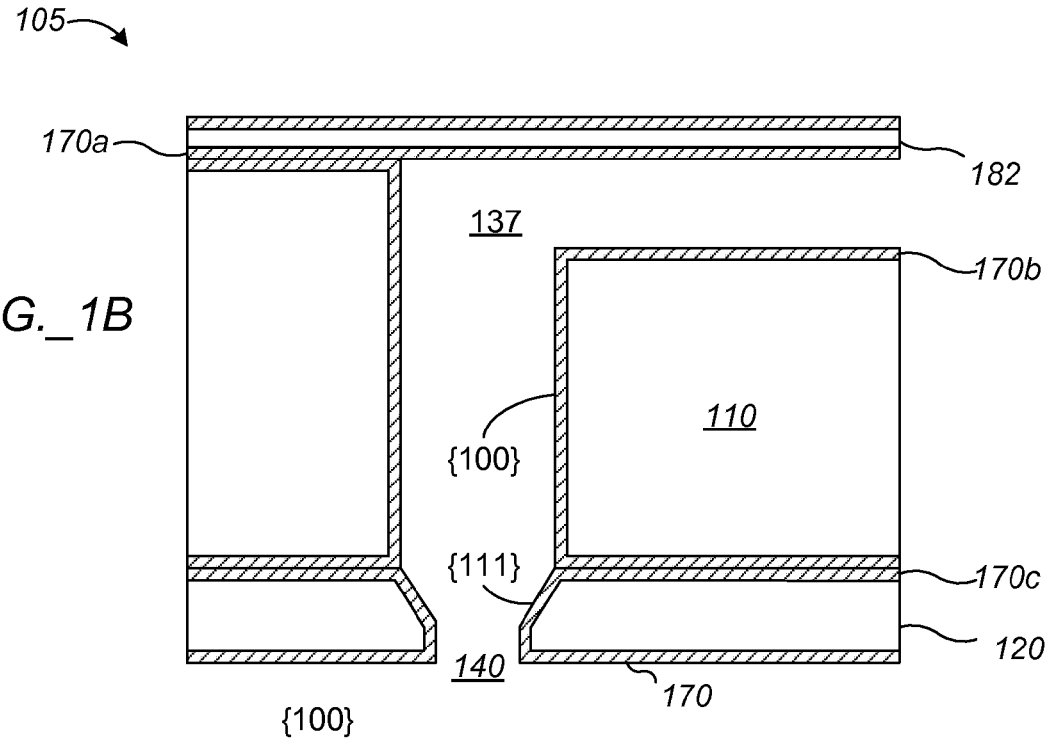
FIG. 1B is a cross-sectional view of an implementation of the fluid ejector of FIG. 1A having an oxide coating.

As shown in FIG. 1B, a coated fluid ejector 105 can include one or more oxide layers 170, such as one or more silicon oxide layers. The oxide layers 170 can include oxide layers 170*a*, 170*b*, and 170*c* on the membrane 182, flow-path body 110 and nozzle plate 120, respectively. The oxide layer 170*a* can directly contact, e.g. cover, a first outer surface of the membrane layer 182 that is closer to the flow path module 110 and can optionally (as shown in FIG. 1B) cover a second outer surface of the membrane layer 182 that is opposite to the first outer surface of the membrane layer 182 and is farther from the flow path module 110. The oxide layer 170*b* can directly contact, e.g. cover, a first outer surface of the membrane layer flow-path body 110 and the walls of the flow paths 137 and can optionally (as shown in FIG. 1B) cover a second outer surface of the flow-path body 110 that is opposite to the first outer surface of the flow-path body 110. Further, the oxide layer 170*c* can directly contact, e.g. cover, a first outer surface of the nozzle plate 120 that is closer to the flow path module 110 and can optionally (as shown in FIG. 1B) cover a second outer surface of the nozzle plate 120 that is opposite to the first outer surface of the nozzle plate 120 and is farther from the flow path module 110. When bonded as a fluid ejector 105, the oxide layer 170, including oxide layers 170*a*, 170*b*, and 170*c* can include portions that extend between the membrane 182, flow-path body 110, and nozzle plate 120, as well as along the walls of the fluid paths 137.

The portion of the oxide layer 170*a* between the membrane 182 and the fluid flow path 110 can be bonded with a portion of the oxide layer 170*b* between the membrane 182 and the fluid flow path 110 with an oxide-oxide bond. Likewise, a portion of the oxide layer 170*b* between the fluid flow path 110 and the nozzle plate 120 can be bonded with a portion of the oxide layer 170*c* between the fluid flow path 110 and the nozzle plate 120 with an oxide-oxide bond. Thus, the membrane 182, flow-path body 110, and nozzle plate 120 can be assembled to provide the substrate without any intervening layers other than the oxide layers 170*a*, 170*b*, 170*c*.

The oxide layer 170, including oxide layers 170*a*, 170*b*, 170*c* can be a thermal oxide layer. The thickness of the oxide layer 170 can be between 0.1 μm and 5 μm thick, such as greater than 0.1 μm and less than 2 μm thick, for example 0.4 μm or 1 μm thick. Each of the oxide layers 170*a*, 170*b*, and 170*c* can have a uniform thickness along surfaces in the same family of planes, for example, for surfaces along the {100} planes. Thus, the thickness of each of the oxide layers 170*a*, 170*b*, and 170*c* along the surface in a family of planes can vary by less than 5% along a family of planes, such as less than 3% over the length of the layer, over a distance of at least 20 mm, for example at least 50 mm. Further, the oxide layer 170 can have a density of greater than 2.0 g/cm$^3$, such as greater than 2.2 g/cm$^3$, for example 2.6 g/cm$^3$.

Figure 2A:
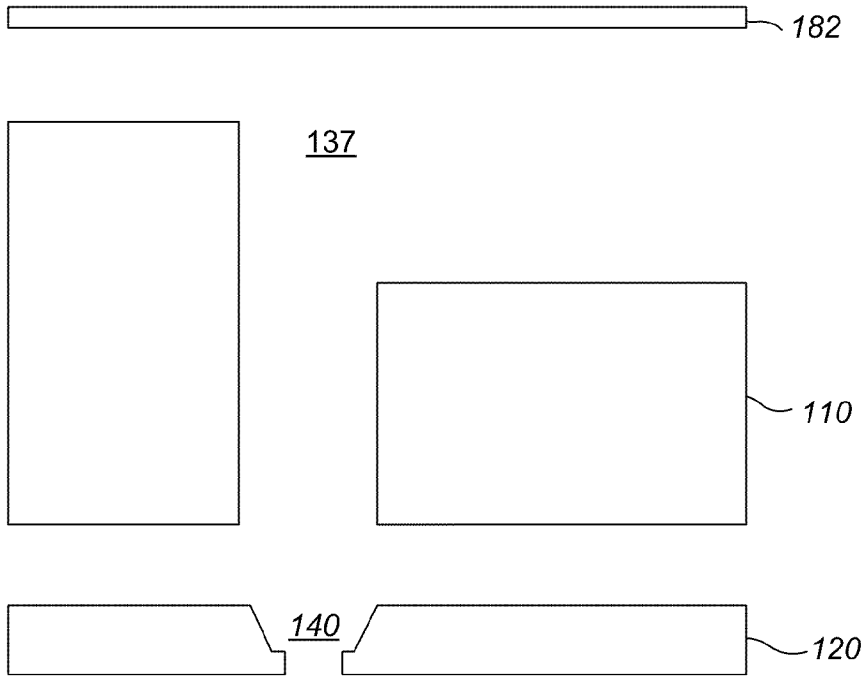
FIGS. 2A-2C illustrate an exemplary process for forming a fluid ejector.
Figure 2B:
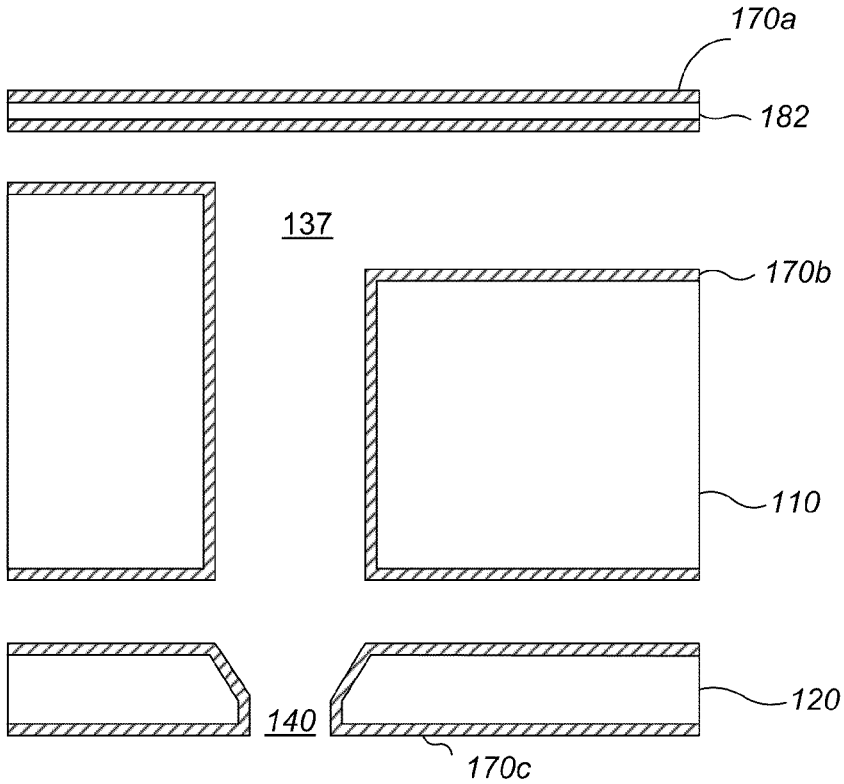
Figure 2C:
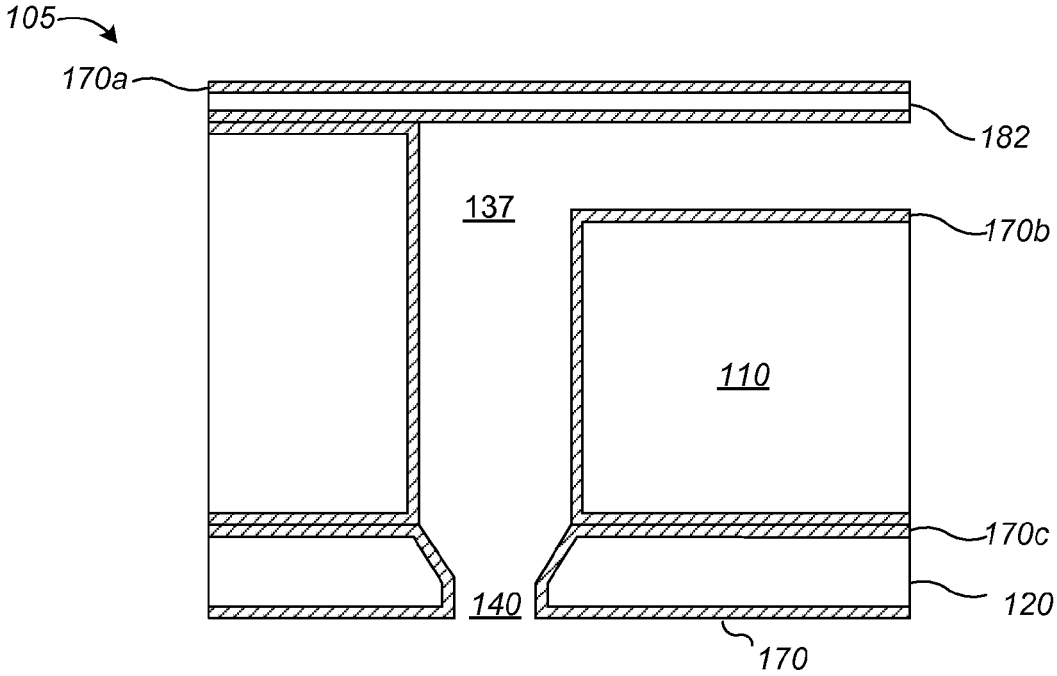

FIGS. 2A through 2C show a process for forming the coated fluid ejector 105. Referring to FIG. 2A, a method of forming the fluid ejector 105 starts with a separate, i.e. unbonded, membrane layer 182, flow-path body 110, and nozzle plate 120. The fluid paths 137 can be pre-etched into the flow-path body 110.

Referring to FIG. 2B, the membrane layer 182, flow-path body 110, and nozzle plate 120 are each individually coated with a corresponding oxide layer 170*a*, 170*b*, and 170*c* using thermal oxidation. The oxide layers 170*a*, 170*b*, and 170*c* can be grown using a wet thermal oxide process in which vaporized water is circulated over the part to be coated, e.g. the membrane layer 182, flow-path body 110, or nozzle plate 120. The wet thermal oxide process can occur at temperatures of between approximately 800° C. and 1200° C., such as 1000° C. to 1100° C., for example 1080° C. The wet thermal oxide process can take between ½ hour and 5 hours, such as 2 hours. The rate of growth of the thermal oxide, and thus the resulting final thickness, can depend on the orientation of the exposed surface. For example, for a (100) silicon, the rate of growth on the {111} planes is 1.7 times faster than on the {100} planes. Therefore, the oxide formed on surfaces along the {100} plane can have a uniform first thickness, while the oxide formed on surfaces along the {111} planes can have a uniform second thickness. Because the rate of growth, and hence the density of atoms, is greater along the {111} plane, there may be a thicker layer of thermal oxide deposited on the {111} surfaces in comparison to the {100} surfaces.

Referring to FIG. 2C, the membrane layer 182, flow-path body 110, and nozzle plate 120 are then bonded together to form an oxide-oxide bond. The oxide-oxide bond can occur at a temperature of greater than approximately 1000° C., such as between approximately 1200° C. and 1300° C.

In some embodiments, a non-wetting coating can be deposited onto the oxide layer.

Figure 3A:
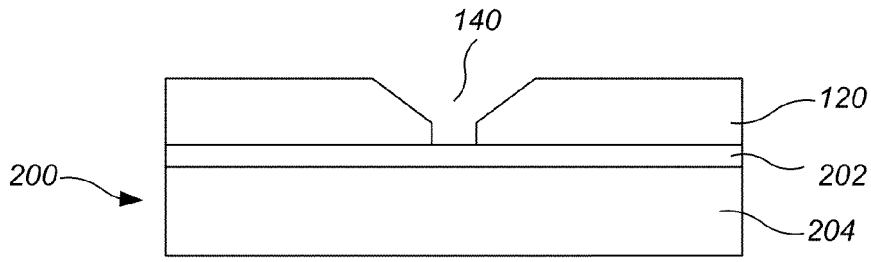
FIGS. 3A-3D illustrate another exemplary process for forming a fluid ejector.
Figure 3B:
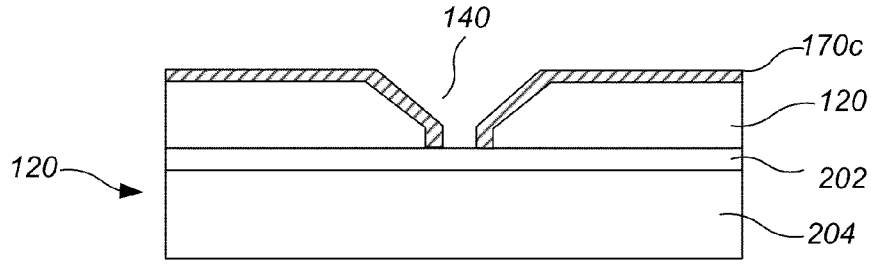
Figure 3C:
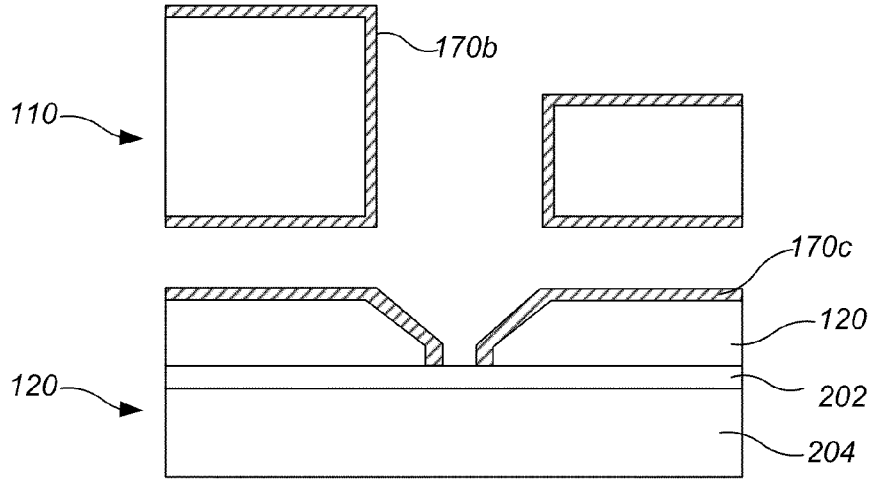
Figure 3D:
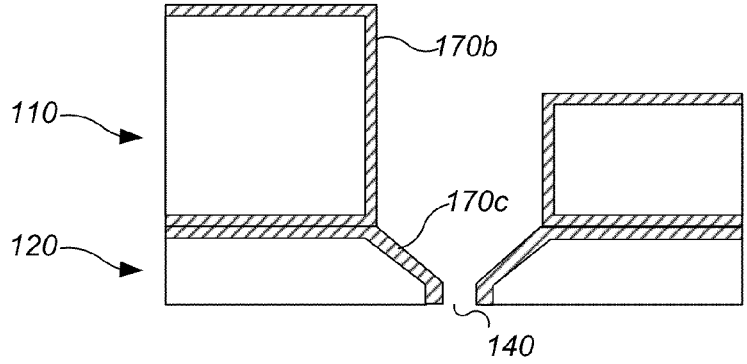

In some embodiments, as shown in FIG. 3A, the nozzle plate 120 is initially the silicon layer of a silicon-on-oxide (SOI) wafer 200 that includes an oxide layer 202 and a handle layer 204. In such embodiments, the orifice 140 can be etched into the silicon layer 120, e.g., using the oxide layer 202 as an etch stop. As shown in FIG. 3B, the oxide 170*c* is then formed on the exposed surface of the silicon layer 120, i.e, on the surface of the layer 120 opposite the oxide layer 202, using the process described above (the oxide is not formed on the buried surface of the silicon layer 120, which can later become the exposed surface of the nozzle plate 120). Optionally an oxide layer can be formed on the exposed surface of the handle layer 204 at the same time. As shown in FIG. 3C, the flow-path body 110 and nozzle plate 120 are then bonded together to form an oxide-oxide bond between the oxides 170*b*, 170*c*. After bonding, as shown in FIG. 3D, the handle layer 204, and optionally the oxide layer 202, can then be removed, e.g., by grinding and/or etching.

Figure 4A:
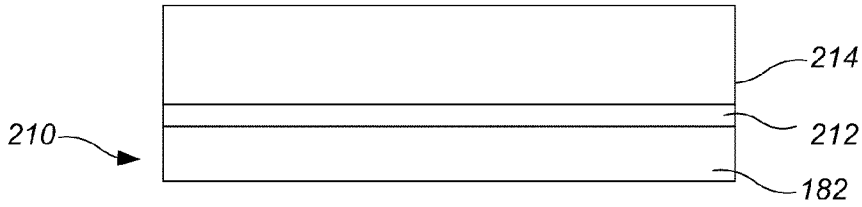
FIGS. 4A-4D illustrate another exemplary process for forming a fluid ejector.
Figure 4B:
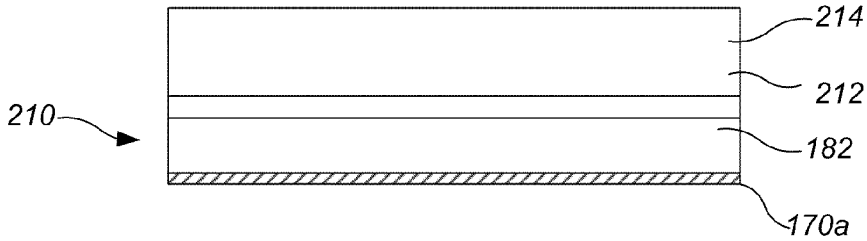
Figure 4C:
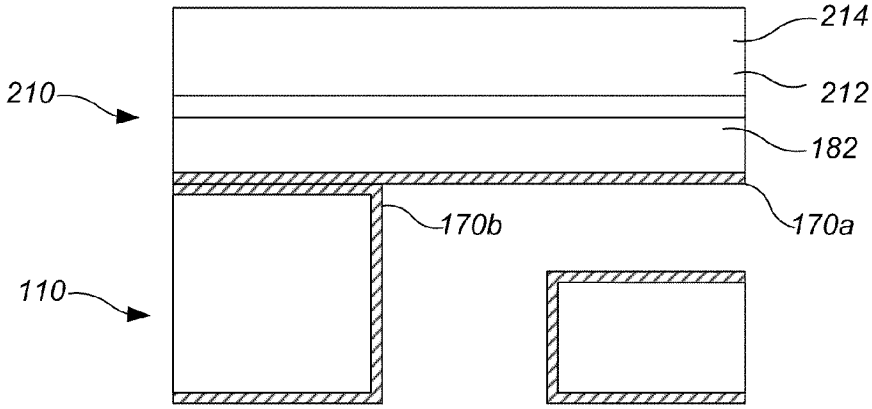
Figure 4D:
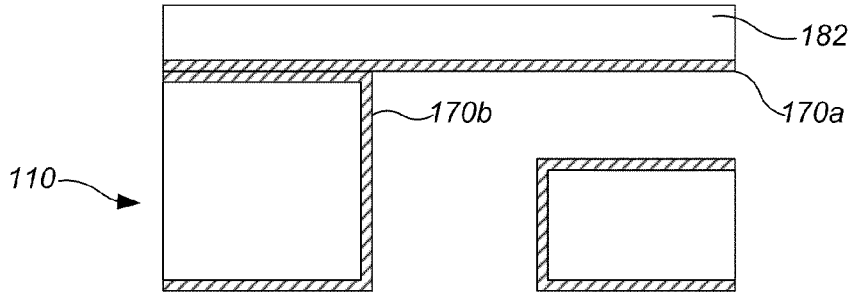

Similarly, in some embodiments, as shown in FIG. 4A, the membrane 182 is initially the silicon layer of a silicon-on-oxide (SOI) wafer 210 that includes an oxide layer 212 and a handle layer 214. As shown in FIG. 4B, the oxide 170*a* is formed on the exposed surface of the silicon layer 182, i.e., on the surface of the layer 182 opposite the oxide layer 212, using the process described above (the oxide is not formed on the buried surface of the silicon layer 182, which can later become the exposed surface of the membrane 182). Optionally an oxide layer can be formed on the exposed surface of the handle layer 214 at the same time. As shown in FIG. 4C, the flow-path body 110 and membrane 182 are then bonded together to form an oxide-oxide bond between the oxides 170*a*, 170*b*. After bonding, as shown in FIG. 4D, the handle layer 214, and optionally the oxide layer 212, can then be removed, e.g., by grinding and/or etching.

By using thermal oxidation to coat the fluid paths, a dense oxide layer forms continuous, pinhole-free surfaces that are inert and resistant to etching by aggressive fluids, such as alkaline fluids. Moreover, by using a thermal oxide rather than a chemical vapor deposition (CVD) oxide, the oxide layer can have higher integrity, higher uniformity, fewer defects, and can be bonded together without cleaning or polishing. Finally, by forming a thermal oxide layer separately on the membrane, flow-path body, and nozzle plate before bonding the parts together, warping of the fluid ejector that would otherwise occur as a result of varying stresses in the different material can be avoided.

Particular embodiments have been described. Other embodiments are within the scope of the following claims.

What is claimed is:

1. A fluid ejector, comprising:

a flow-path body having a first outer surface and an opposing second outer surface and a plurality of flow paths, each flow path extending at least from the first outer surface to the second outer surface;

a first oxide layer coating at least an interior surface of each of the flow paths and the first and second outer surfaces of the flow-path body, wherein the first oxide layer has a thickness that varies by less than 5% along {100} planes;

a membrane having a first outer surface; and a second oxide layer coated on the first outer surface of the membrane, wherein the second oxide layer has a thickness that varies by less than 5% along {100} planes, and wherein the second oxide layer is bonded to the first oxide layer.

2. The fluid ejector of claim 1, further comprising a nozzle plate having a first outer surface and a third oxide layer coated on the first outer surface of the nozzle plate, wherein the third oxide layer has a thickness that varies by less than 5%, and wherein the third oxide layer is bonded to the first oxide layer.

3. The fluid ejector of claim 1, wherein the first and second oxide layers have a thickness of between approximately 0.1 μm and 5 μm.

4. The fluid ejector of claim 3, wherein the thickness of each of the first and second oxide layers is less than approximately 2 μm.

5. The fluid ejector of claim 1, wherein the first and second oxide layers each have a density of greater than about 2.0 $g/cm^3$.

6. The fluid ejector of claim 5, wherein the first and second oxide layers each have a density of greater than about 2.2 $g/cm^3$.

7. The fluid ejector of claim 1, wherein the flow-path body comprises silicon.

8. The fluid ejector of claim 1, wherein the membrane comprises single-crystal silicon.

9. The fluid ejector of claim 1, wherein the first and second oxide layers comprise silicon oxide.

10. The fluid ejector of claim 1, wherein the first and second oxide layers each have a thickness that varies by less than 3%.

11. A method of forming a fluid ejector, comprising:

forming a first thermal oxide layer on at least one surface of a membrane;

forming a second thermal oxide layer on at least one surface of a flow-path body, the flow-path body comprising a plurality of flow paths; and bonding the first thermal oxide layer to the second thermal oxide layer.

12. The method of claim 11, wherein bonding the first thermal oxide layer to the second thermal oxide layer includes forming an oxide-to-oxide bond.

13. The method of claim 11, wherein forming the second oxide layer includes forming a thermal oxide layer along a wall of each flow path.

14. The method of claim 13, wherein the second oxide layer has a thickness that varies by less than 5% along {100} planes.

15. The method of claim 14, further comprising forming a third oxide layer on at least one surface of a nozzle plate and bonding the third oxide layer to the second oxide layer.

16. The method of claim 11, wherein the bonding occurs at a temperature of greater than approximately 1000° C.

17. The method of claim 16, wherein the temperature is between approximately 1200° C. and 1300° C.

18. The method of claim 11, wherein the first and second thermal oxide layers are between approximately 0.1 μm and 5 μm thick.

19. The method of claim 18, wherein the first and second thermal oxide layers are less than approximately 2 μm thick.

* * * * *